US005164738A

United States Patent [19]

Walter et al.

[11] Patent Number: 5,164,738

[45] Date of Patent: Nov. 17, 1992

[54] WIDEBAND DUAL-POLARIZED MULTI-MODE ANTENNA

[75] Inventors: Carlton H. Walter; Donn V. Campbell, both of Poway, Calif.

[73] Assignee: TRW Inc., Redondo Beach, Calif.

[21] Appl. No.: 602,581

[22] Filed: Oct. 24, 1990

[51] Int. Cl.[5] ..... H01Q 11/10

[52] U.S. Cl. ..... 343/789; 343/792.5

[58] Field of Search ..... 343/789, 792.5, 895, 343/705

[56] References Cited

U.S. PATENT DOCUMENTS

| | | | |
|---|---|---|---|
| 2,990,547 | 6/1961 | McDougal | 343/767 |
| 3,349,404 | 10/1967 | Copeland et al. | 343/120 |
| 4,063,249 | 12/1977 | Bergander et al. | 343/756 |
| 4,243,993 | 1/1981 | Lamberty et al. | 343/895 |
| 4,594,595 | 6/1986 | Struckman | 343/770 |
| 4,608,572 | 8/1986 | Blakney et al. | 343/792.5 |
| 4,649,391 | 3/1987 | Tsuda et al. | 342/153 |
| 4,658,262 | 4/1987 | DuHamel | 343/792.5 |
| 4,675,685 | 6/1987 | Finken | 343/708 |
| 4,772,891 | 9/1988 | Svy | 343/707 |
| 4,785,307 | 11/1988 | Kuo | 343/792.5 |
| 4,791,429 | 12/1988 | Hannan | 343/789 |

*Primary Examiner*—Michael C. Wimer

*Attorney, Agent, or Firm*—Noel F. Heal; Ronald L. Taylor

[57] ABSTRACT

A generally planar antenna structure having at least six radial antenna elements, each of which uses log-periodic principles to provide a broad bandwidth of operation. Each antenna element has a radial arm and integral, arcuate teeth extending in opposite directions from the radial arm, such that the spacing, width and length of the teeth increases with increasing radial distance from the center of the structure. The teeth are preferably interleaved with teeth in adjacent antenna elements. A feed region of the structure is provided near its center, to connect the antenna elements through a connection matrix to input/output terminals and provide operation in multiple modes and multiple polarization senses. The antenna structure is capable of operating in high order modes, to provide multifunctional operation and enhanced performance in angle-of-arrival systems, and is capable of transmitting and receiving both right-hand and left-hand circularly polarized signals, and all dual linearly polarized signals, all over a broad frequency band.

4 Claims, 8 Drawing Sheets

| MODE | 1 | 2 | 3 | 4 | 5 | 6 | 7 | 8 |
|---|---|---|---|---|---|---|---|---|
| 1 | 0 | 45 | 90 | 135 | 180 | 225 | 270 | 315 |
| 2 | 0 | 90 | 180 | 270 | 0 | 90 | 180 | 270 |
| 3 | 0 | 135 | 270 | 45 | 180 | 315 | 90 | 225 |
| −3 | 0 | 225 | 90 | 315 | 180 | 45 | 270 | 135 |
| −2 | 0 | 270 | 180 | 90 | 0 | 270 | 180 | 90 |
| −1 | 0 | 315 | 270 | 225 | 180 | 135 | 90 | 45 |

MODE 1 SENSE OPPOSITE MODE −1
MODE 2 SENSE OPPOSITE MODE −2
MODE 3 SENSE OPPOSITE MODE −3

WIDEBAND DUAL-POLARIZED MULTI-MODE ANTENNA

BACKGROUND OF THE INVENTION

This invention relates generally to antennas and, more particularly, to antennas used in high performance military aircraft. There is a requirement for such aircraft to sense incident electromagnetic energy instantaneously over a broad frequency band, for example from 2 to 20 GHz (gigahertz). Moreover, the polarization of the incident radiation may be linear horizontal polarization, linear vertical polarization, right-hand circular polarization (RCP), or left-hand circular polarization (LCP).

A right-hand circularly polarized sensor antenna will detect linearly polarized or right-hand elliptical or circular polarized radiation, but will not detect electromagnetic radiation of the left-hand polarization sense. Therefore, a system equipped with conventional single-sense antennas, such as broadband spiral antennas, will be unable to detect electromagnetic radiation of the opposite polarization sense.

One solution to this difficulty is to provide both left-hand and right-hand spiral antennas. However, space for multiple antennas may not be available in some aircraft.

Sensor antennas in some aircraft are used to provide angle-of-arrival signals, i.e. to provide information concerning the angular direction of a signal source. The accuracy of angle-of-arrival systems can be improved if the sensor antenna can operate in higher order modes. In particular, a multi-mode antenna offers the advantage of increased gain at small elevation angles above the plane containing the antenna aperture. Military aircraft antennas are often installed in locations that compromise antenna performance, specifically the radiation pattern and gain. For example, antennas may be installed on the side or top of the fuselage and will have difficulty "seeing" in a forward or backward direction relative to the aircraft's direction of motion.

It will be appreciated that there is a significant need for a single antenna that overcomes all of the shortcomings mentioned above. As will become apparent from the following summary, the present invention satisfies this need.

SUMMARY OF THE INVENTION

The present invention resides in a single, low profile antenna that is capable of receiving electromagnetic signals over a broad band of frequencies, regardless of the polarization of the signals, and is capable of operating in high order modes to provide multifunction antenna performance as well as accurate angle-of-arrival information and increased gain at low elevation angles above the plane containing the antenna aperture. Briefly, and in general terms, the antenna structure of the invention comprises at least six antenna elements, each element having a radial arm and multiple arcuate teeth that are integral with the arm and extend from it on both sides, wherein the teeth increase in width, length and spacing, between a feed region close to the center of the antenna structure and a region close its outer periphery, to provide a log-periodic characteristic. An equal number of electromagnetic transmission lines are connected to the antenna elements at a feed region of the antenna structure near its center, and the structure also comprises a matrix of hybrid junctions connected to the antenna elements through the transmission lines and having input/output terminals for operation of the antenna structure in multiple modes and circular polarization senses.

Preferably, the teeth on adjacent antenna elements are at least partially interleaved, such that each tooth of each antenna element extends without contact between two teeth of an adjacent antenna element. In the embodiment illustrated, there are eight antenna elements, and the matrix provides input/output terminals for operation of the antenna structure to transmit and receive signals of right-hand and left-hand circular polarization, and in multiple modes. More specifically, the antenna structure has a diameter large enough to support operation in a second or higher order mode, to provide multifunction antenna performance as well as increased gain at lower elevations above the plane of the antenna structure.

In the presently preferred embodiment of the invention, the antenna elements are formed from a layer of conductive material on a generally planar or near planar substrate of insulating material, and the substrate is appropriately dimensioned to cover a cavity formed in an aircraft fuselage and to conform to the surface contours of the fuselage. The cavity is filled with radiation-absorbing material to minimize radiation in a direction into the aircraft fuselage, and to minimize detection of radiation from the same direction.

The antenna structure of the invention provides the ability to operate in multiple modes, to transmit and receive both right-hand and left-hand circularly polarized signals, and to operate over a broad bandwidth. Operation in high order modes provides increased antenna gain at low elevation angles with respect to the plane of the antenna, enhances performance in angle-of-arrival systems, and provides multi-function operation from a single aperture. All of these features are provided for the first time in a single low-profile antenna structure. Other aspects and advantages of the invention will become apparent from the following more detailed description, taken in conjunction with the accompanying drawings.

DESCRIPTION OF THE PREFERRED EMBODIMENT

Figure 1:
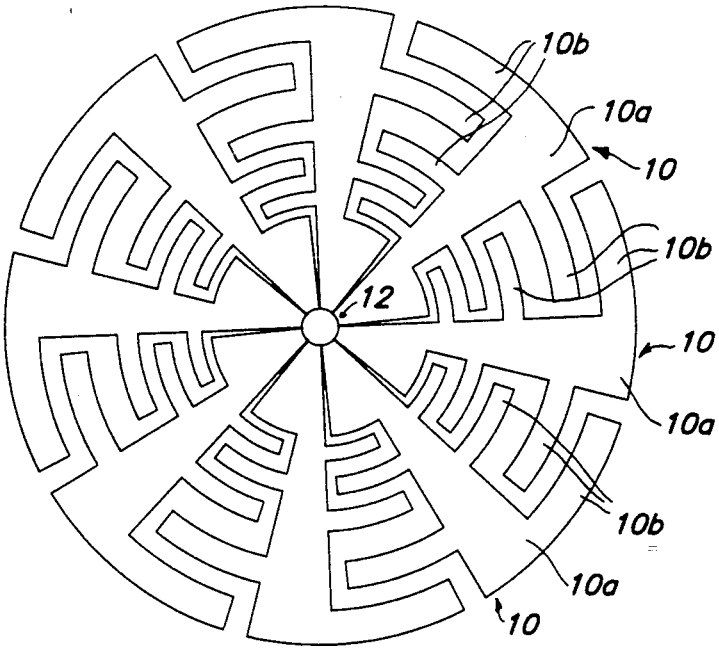
FIG. 1 is a simplified plan view of an antenna structure in accordance with the invention.

As shown in the drawings by way of example, the present invention is concerned with antennas for high-performance military aircraft. Prior to this invention, no single antenna has been able to detect all incident radiation, regardless of its polarization, or to operate in higher order modes, with high gain at low elevational angles.

In accordance with the invention, a single low-profile antenna provides broadband detection of electromagnetic radiation, of any polarization, and is capable of operating in high order modes to provide multifunction operation and facilitate operation in angle-of-arrival systems. The low profile of the antenna is achieved by using a cavity-backed planar or conformal configuration, to provide an antenna that can be made flush with the outer skin of an aircraft fuselage. Wideband performance is achieved by means of a log-periodic or pseudo log-periodic antenna configuration, which yields frequency-independent operation. The ability to receive either right-hand or left-hand circularly polarized radiation is obtained by the use of multiple log-periodic or pseudo log-periodic antennas and a feed system that can select either the right-hand or the left-hand phase progression. The ability to operate in high order modes is obtained through the use of multiple log-periodic or pseudo log-periodic elements of sufficiently large diameter to accommodate the high order modes, and a feed system for exciting these modes.

More specifically, and as shown by way of example in FIG. 1, the antenna structure of the present invention takes the form of a multiple-arm array of log-periodic antenna elements arranged in a circular configuration. The figure shows eight log-periodic antenna elements, indicated by reference numeral 10, extending in a generally radial direction from a central antenna feed region 12. Each of the eight antenna elements 10 comprises a sector arm 10*a* bounded by two radial lines emanating from the feed region 12, and a plurality of integral and arcuate teeth 10*b*, which extend in opposite directions from the sector arm. The teeth 10*b* on each side of the sector arm 10*a* follow generally part-circular paths and are staggered in position, i.e. a tooth on one side of the sector arm is positioned at a radial distance between two teeth on the other side of the sector arm. The lengths and widths of the teeth 10*b* increase with their radial distance from the feed region 12, consistent with principles of log-periodic antenna design. Moreover, the teeth 10*b* of each sector arm 10*a* are interdigitated with the teeth of adjacent sector arms, i.e. the teeth are interleaved without touching, such that a tooth from one sector arm is positioned between two teeth from an adjacent sector arm. The small circles 16 in FIG. 1 indicate points at which transmission lines may be connected to the antenna elements 10.

The active region for each log-periodic or pseudo log-periodic antenna element 10 is located at a radial distance at which the teeth are about one-quarter wavelength long. Therefore, at lower frequencies the active region is located near the outer periphery of the structure, and at higher frequencies the active region is closer to the center of the structure, where the teeth are shorter.

Figure 2A:
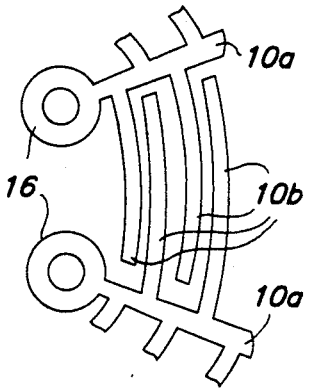
FIG. 2*a* is an enlarged fragmentary view of a central portion of the antenna structure of FIG. 1*a*, showing antenna feed connections.
Figure 2:
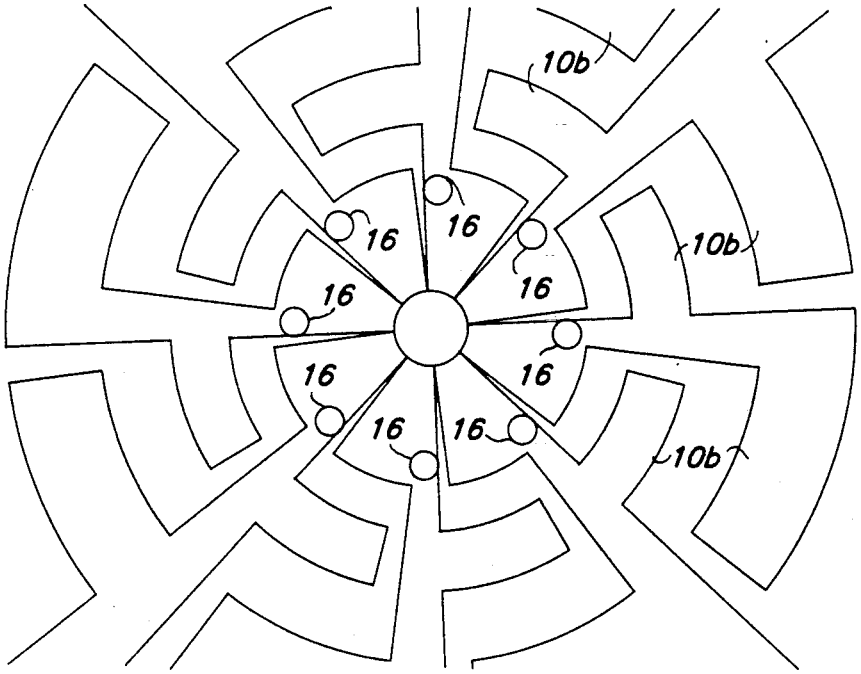
FIG. 2 is an enlarged fragmentary view of a central portion of the antenna structure of FIG. 1, showing antenna feed connections.
Figure 1A:
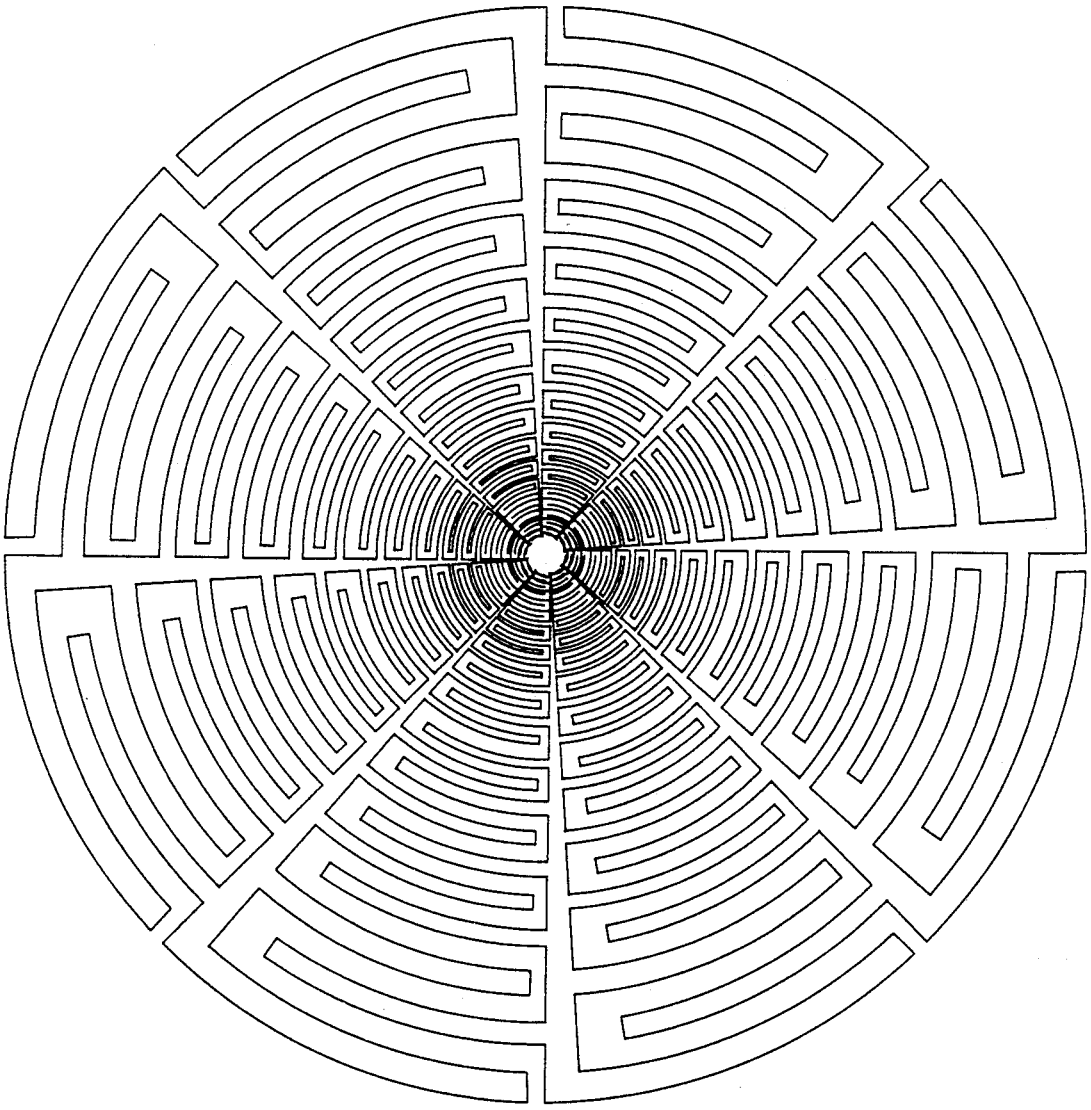
FIG. 1*a* is a plan view corresponding to FIG. 1 and showing a more practical embodiment of the antenna structure.

The teeth, the sector arms, and the number of teeth are design parameters that can be adjusted to tailor the antenna performance to meet desired specifications. Only a few teeth are shown in FIG. 1 for simplicity. An illustration of a more practical embodiment of the antenna is shown in FIG. 1*a*. FIG. 2*a* is an enlarged fragmentary view of a portion of the antenna structure of FIG. 1*a*, showing how feed connections are made with each of the antenna elements.

The antenna outside diameter is dimensioned such that the antenna will support a desired number of modes. The fundamental mode of operation of an antenna (mode 1) provides a single-lobed gain characteristic. That is to say, in an antenna of planar configuration, the antenna gain will be highest straight above the antenna, or along the antenna "boresight," as this direction is known. Lower antenna gains are obtained in directions of lower elevation with respect to the plane of the antenna. For higher modes, such as modes 2 and 3, the antenna gain characteristic has multiple lobes and provides a higher gain than mode 1 in directions of lower elevation with respect to the antenna plane.

In the case of an eight-arm antenna, three right-hand sense modes and three left-hand sense modes are possible. In theory, a spiral antenna should be at least three wavelengths in circumference at the lowest frequency for which mode 3 is required. In the case of this multimode log-periodic or pseudo log-periodic antenna, the outside diameter will also depend on the degree of tooth overlap. For example, an eight-arm log-periodic or pseudo log-periodic antenna with 50 percent tooth overlap will have a circumference of at least three wavelengths at its lowest operating frequency. In the same antenna but with no tooth overlap, a four-wavelength circumference would be required.

Figures 5, 6:
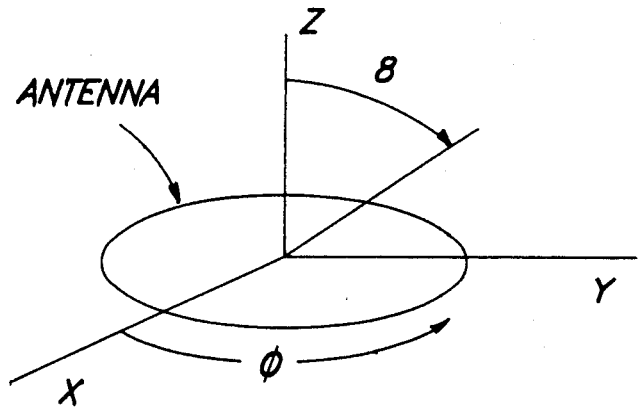
FIG. 5 is a diagrammatic view showing the convention used for identifying the axes of a coordinate system and for measuring elevation and azimuth angles.
FIG. 6 is a table showing the excitation phase angle at each of eight antenna elements, for each of six modes of operation.

FIG. 5 shows the coordinate system used for gain and phase pattern measurements of the antenna of the invention. The antenna is assumed to be positioned in the x-y plane, with the z direction perpendicular to the antenna. The polar angle (theta) is measured with respect to the z-axis direction and the azimuth angle (phi) is measured with respect to the x-axis direction.

Figure 3A:
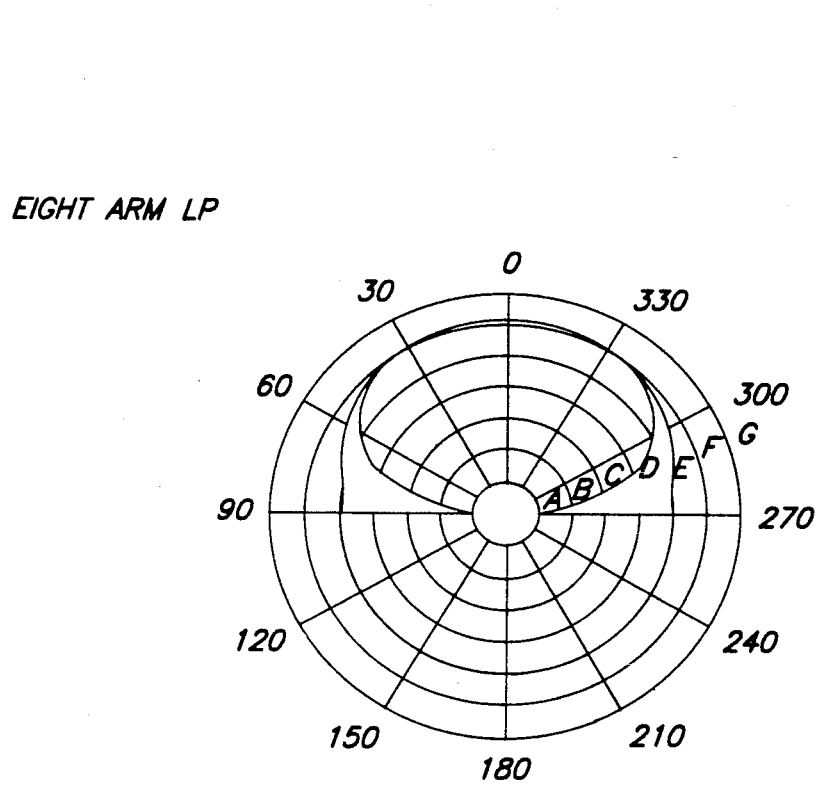
FIGS. 3*a* and 3*b* are graphs of the gain patterns of the antenna of the invention, showing the variation of antenna gain with elevation angle above the plane of the antenna, for mode 1 and right-hand circular polarization, and mode 1 and left-hand circular polarization, respectively.
Figure 3B:
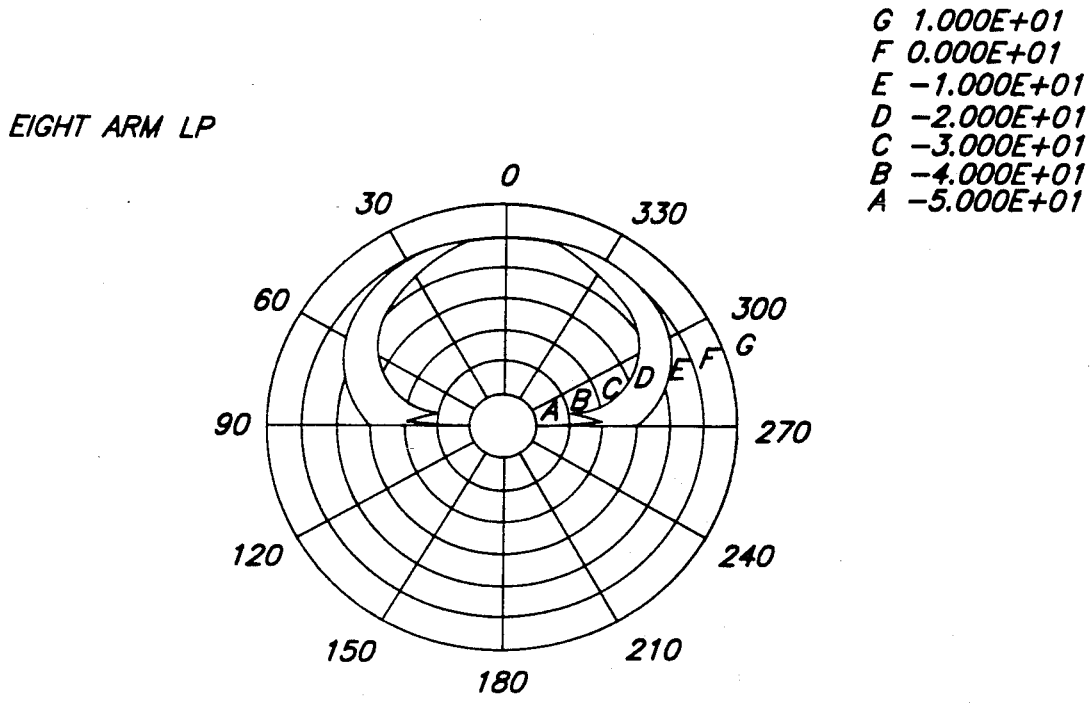
Figure 3C:
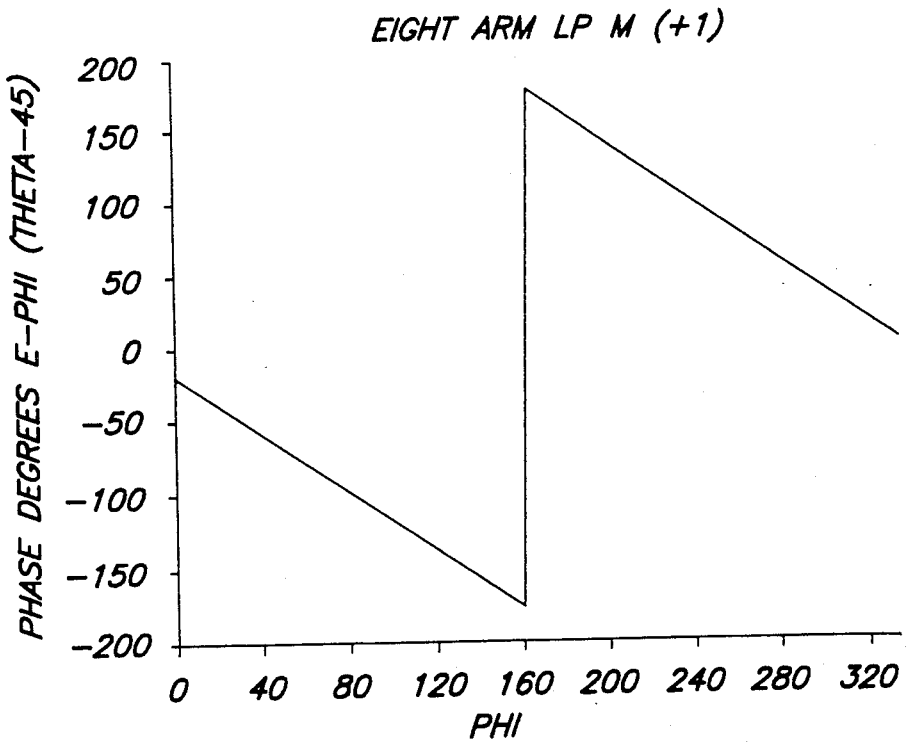
FIGS. 3*c* and 3*d* are graphs of phase patterns corresponding to FIGS. 3*a* and 3*b*, respectively, and showing variation of phase angle with azimuth angle.
Figure 3D:
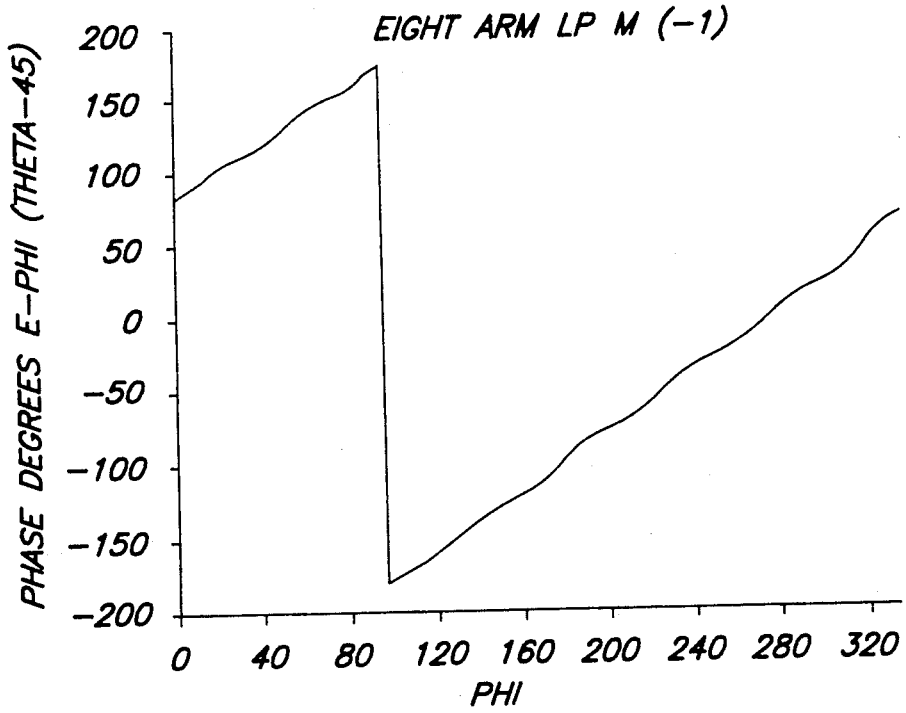

FIGS. 3*a* and 3*b* depict gain patterns for an eight-arm antenna constructed in accordance with the invention, operating mode 1. FIG. 3*a* shows the gain pattern for right-hand circular polarization, indicated as +1 mode, and FIG. 3*b* shows the gain pattern for left-hand circular polarization, indicated as the −1 mode. It will be seen that the gain pattern in both cases has a single lobe centered on the antenna boresight (theta=0 degrees). FIGS. 3*c* and 3*d* show the corresponding phase patterns for varying azimuth angles (phi).

Figure 4A:
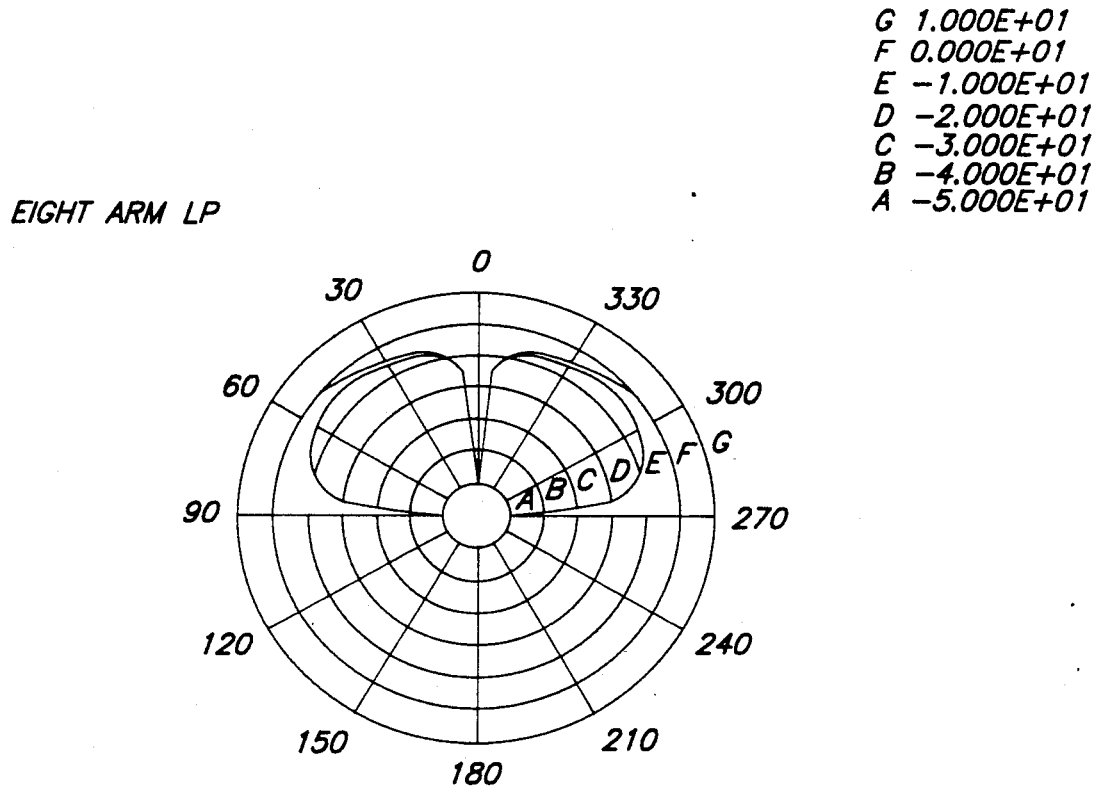
FIGS. 4*a* and 4*b* are gain pattern graphs similar to FIGS. 3*a* and 3*b*, but for mode 2 operation.
Figure 4B:
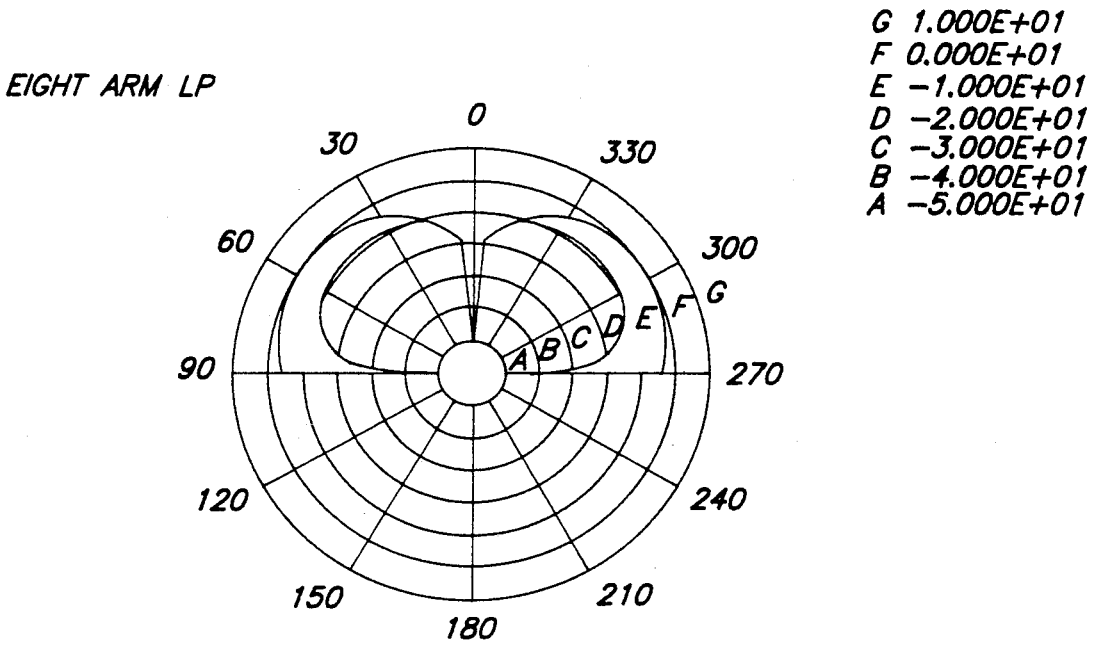
Figure 4C:
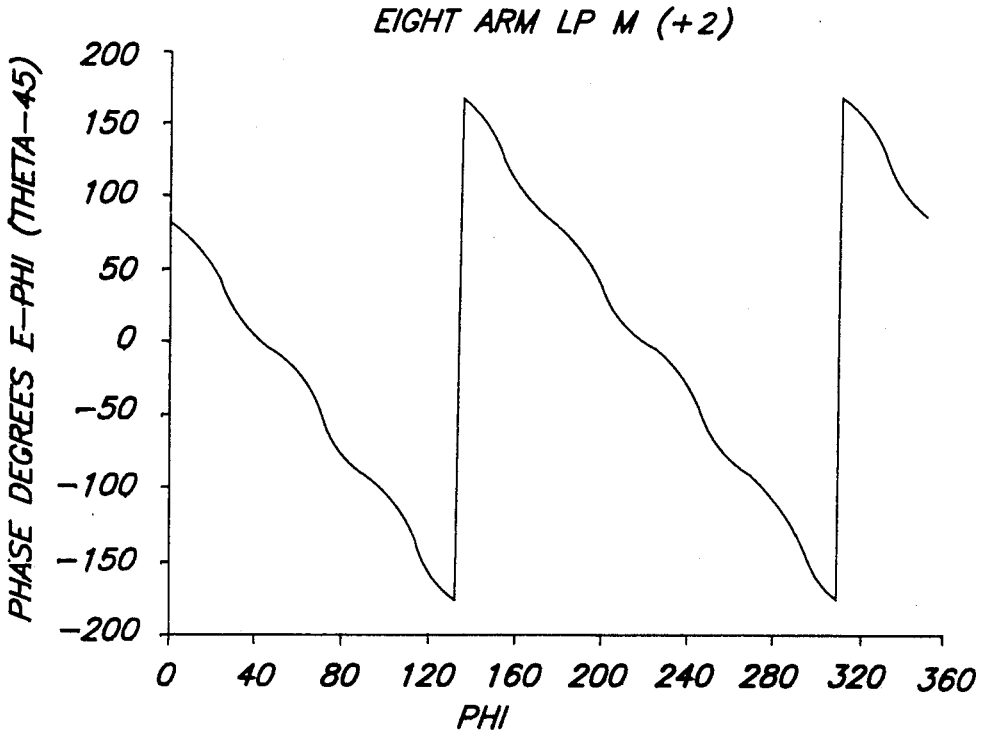
FIGS. 4*c* and 4*d* are phase pattern graphs similar to FIGS. 3*d* and 3*d*, but for mode 2 operation.
Figure 4D:
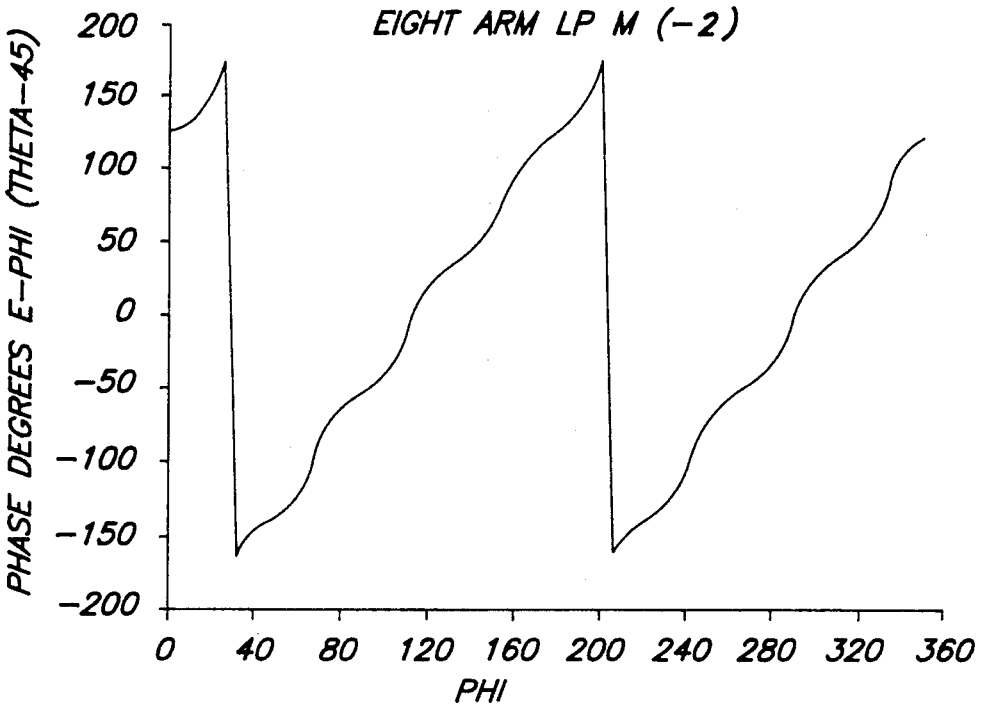

FIGS. 4*a*–*d* are similar to FIGS. 3*a*–3*d*, but for mode-2 operation. FIG. 4*a* is the gain pattern for the right-hand circular polarization case, mode +2, and FIG. 4*b* is the gain pattern for the left-hand circular polarization case. It will be observed that the gain pattern is double lobed and that the gain at lower elevations (theta=90 and 270 degrees) is increased compared to mode-1 operation. The phase pattern for the +1 and −1 modes (FIGS. 3*c* and 3*d*) are nearly linear and practically ideal. The corresponding phase patterns for the +2 and −2 modes (FIGS. 4*c* and 4*d*) indicate a slight departure from strict linearity.

FIG. 6 is a table giving the excitation phases at each of the eight antenna elements, for each of six modes of operation, including modes +1, +2, +3, −1, −2 and −3. For mode 1, the excitation phase changes by 45 degrees from one antenna element to the next and goes through a full 360-degree cycle corresponding to one progression through all of the elements in turn. For mode 2, the excitation phase changes by 90 degrees from one antenna element to the next and goes through two full 360-degree cycles for one cycle of all eight antenna elements. This is consistent with the phase pattern diagrams of FIGS. 3*c*, 3*d*, 4*c* and 4*d*.

Antenna structures similar to FIG. 1 but having other than eight arms would also be in conformance with the invention. A six-arm antenna structure would be capable of operating in modes ±1 and modes ±2, i.e. it would have gain and phase patterns similar to those of FIGS. 3*a*–3*d* and 4*a*–4*d*. Similarly, an antenna structure having more than eight antenna elements would operate in the same way, but would need an elaborate feed system for proper excitation of the additional arms. Such an antenna structure would offer further increased gain at low elevation angles and have the advantage of improved angle-of-arrival accuracy.

Figure 8:
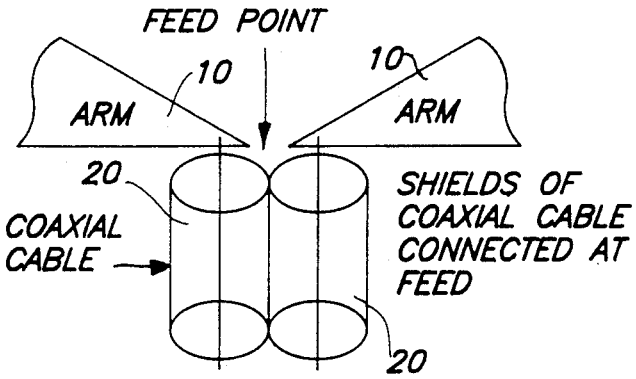
FIG. 8 is a diagrammatic view showing the connection of coaxial transmission lines to two antenna elements of the antenna structure of the invention.

As shown in FIG. 8, each antenna element or arm 10 is connected to a shielded coaxial cable 20 to provide feed connections. The figure shows only two such connections and cables, but it will be understood that there will be as many coaxial cables as there are antenna arms. The cable shields are tied together to a common ground. It will also be understood that other types of transmission lines may be used, such as microstrip or stripline, instead of coaxial cable.

Figure 7:
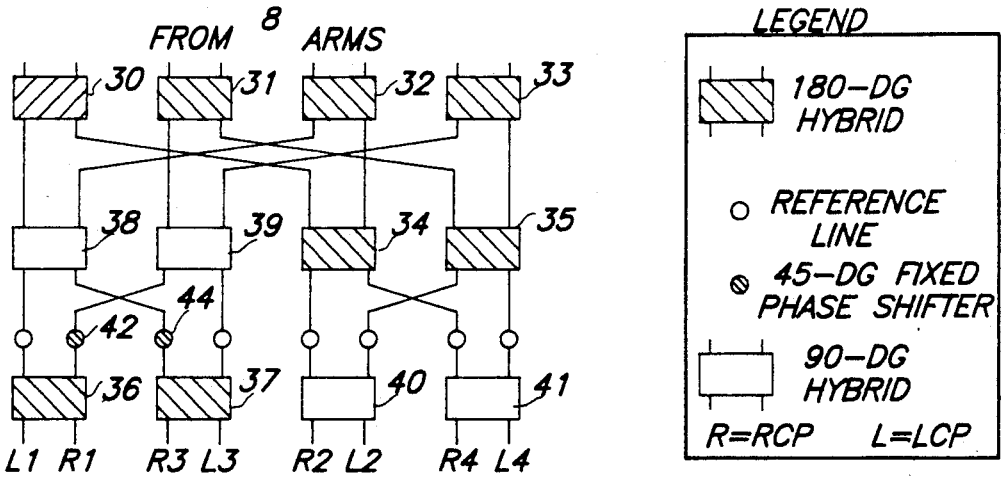
FIG. 7 is a schematic diagram showing a Butler matrix feed arrangement for the antenna of the invention, showing the interconnection of eight antenna elements to provide multiple antenna modes.

For the eight-arm antenna structure of FIG. 1, a total of eight modes of operation are derived in accordance with the Butler matrix-type feed shown in FIG. 7. Basically, the matrix provides eight output terminals, for the eight different modes, corresponding to +1 through +4 and −1 through −4 in the terminology previously used. In FIG. 7, as indicated in its accompanying legend, right-hand circular polarization is indicated by the R, and left-hand circular polarization by the letter L. The matrix includes eight 180-degree hybrid junctions 30–37 and four 90-degree hybrid junctions 38–41. The hybrid junctions may be considered to be arranged in three rows of four modules in each. In the first row, the eight antenna arms are connected to the inputs of four 180-degree hybrid junctions 30–33, and the outputs of these modules are connected, using the configuration shown in FIG. 7, to the inputs of the modules on the second row, which includes two 180-degree hybrids 34, 35 and two 90-degree hybrids 38, 39. The outputs of the second row of modules are connected as shown to the inputs of the third row, which includes the remaining hybrids 36, 37, 40, 41, two of the connections requiring 45-degree fixed phase shifters, shown at 42, 44. Finally, the outputs of the third row of modules provide the desired alternative modes of operation of the antenna structure, including modes L1, L2, L3, L4, R1, R2, R3 and R4.

Figure 9:
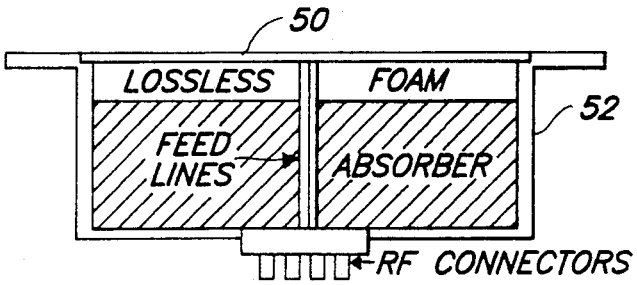
FIG. 9 is a simplified elevational view, partly in section, of the antenna structure of the invention installed in a cavity formed in the surface of an aircraft fuselage.

FIG. 9 shows a typical physical configuration for the antenna structure of the invention. Antennas of this type are usually formed by etching away unwanted portions of a conductive layer formed on a planar or near planar board or substrate, indicated at 50, which is installed over a cavity 52 in the surface of an aircraft. Beneath the antenna plane 50 is a quantity of lossless foam, and beneath that the cavity 52 is filled with a radiation absorbing material, to ensure that most of the radiation from the antenna is directed away from the aircraft. Similarly, the antenna structure acting as a receiver will be sensitive to radiation from outside the aircraft, and above the surface 50 shown in FIG. 9.

The principal advantages of the antenna structure of the present invention are that it can transmit and receive all senses of polarization in a single antenna structure, thus reducing the number of required antennas in some aircraft, and that it is capable of operation over a wide band of frequencies and in multiple modes. Further, the antenna structure provides increased gain at low elevation angles above the plane of the antenna, provides a basically omnidirectional gain pattern with respect to azimuthal angles, provides angle-of-arrival signals with increased accuracy because of the high order modes of operation, and provides stable polarization characteristics without additional circuitry. It will also be appreciated that, although an embodiment of the invention has been described in detail for purposes of illustration, various modifications may be made without departing from the spirit and scope of the invention. Accordingly, the invention is not to be limited except as by the appended claims.

We claim:

1. A generally planar antenna structure providing for operation in multiple modes and capable of transmitting and receiving over a wide bandwidth in both circular polarization senses, the antenna structure comprising:

at least six antenna elements, each element having a radial arm and multiple arcuate teeth that are integral with the arm and extend from it on both sides, wherein the width, length and spacing of the teeth increase progressively with their distance from the center of the antenna structure, to provide a characteristic of the log-periodic type;

at least six electromagnetic transmission lines, each of which is connected to a separate one of the antenna elements near the center of the antenna structure; and a matrix of hybrid junctions having a first set of at least six input/output terminals connected to the transmission lines and thence to the antenna elements, and having a second set of input/output terminals for operation of the antenna structure in multiple modes and circular polarization senses;

wherein the teeth on adjacent antenna elements are interleaved, such that each tooth of each antenna element extends without contact between two teeth of an adjacent antenna element;

and wherein the antenna structure has a diameter large enough to support operation in a second or higher order mode, to provide increased gain at lower elevations above the plane of the antenna structure.

2. An antenna structure as defined in claim 1, wherein:

there are eight antenna elements;

the second set of input/output terminals of the matrix provides for operation of the antenna structure to transmit and receive signals of right-hand an left-hand circular polarization, and in multiple modes.

3. An antenna structure as defined in claim 2, wherein:

the circumference of the antenna structure is approximately three to four times the wavelength of the lowest frequency signal to be received or transmitted.

4. An antenna structure as defined in claim 1, wherein:

the antenna elements are formed from a layer of conductive material on a planar or near planar substrate of insulating material;

the substrate is appropriately dimensioned to cover a cavity formed in an aircraft fuselage and to conform to the surface contours of the fuselage; and the cavity is filled with radiation-absorbing material to minimize radiation in a direction into the aircraft fuselage, and to minimize detection of radiation from the same direction.

* * * * *